United States Patent [19]

Johnson et al.

[11] 4,429,942

[45] Feb. 7, 1984

[54] THREADED LAMP ADAPTER

[75] Inventors: George E. Johnson, Bronxville; Walter Newman, Forest Hills, both of N.Y.

[73] Assignee: Leviton Manufacturing Co., Inc., Little Neck, N.Y.

[21] Appl. No.: 420,202

[22] Filed: Sep. 20, 1982

Related U.S. Application Data

[63] Continuation of Ser. No. 211,620, Dec. 1, 1980, Pat. No. 4,360,243.

[51] Int. Cl.[3] ..... H01R 13/02

[52] U.S. Cl. ..... 339/154 L

[58] Field of Search ..... 339/154 L; 192/56 R, 192/41 R, 45.1, 45.2; 313/318; 49/1, 6, 7

[56] References Cited

U.S. PATENT DOCUMENTS

| | | | |
|---|---|---|---|
| 1,193,252 | 8/1916 | Freeman | 339/154 L X |
| 3,228,209 | 1/1966 | Hersey | 192/56 R X |
| 3,281,620 | 10/1966 | Muller | 313/318 X |
| 4,183,604 | 1/1980 | Tjornhom | 339/154 L X |

*Primary Examiner*—Eugene F. Desmond

*Attorney, Agent, or Firm*—Paul J. Sutton

[57] ABSTRACT

An adapter for permitting a lamp to be threaded into a light socket while preventing damage to the socket through application of excessive threading force includes a threaded sleeve rotatably mounted on a cylindrical body and conductive securing means for preventing longitudinal movement of the sleeve with respect to the body, the securing means being urged into sliding electrical contact with the sleeve and being connected to an electrical conductor for maintaining electrical continuity between the sleeve and an energizing terminal of the lamp. A cam on the ring cooperates with an opening in the sleeve for permitting relative rotation between the sleeve and body in one direction when a threshold torque is exceeded to prevent damage to the socket but preventing relative rotation in the other direction so that the lamp and adapter can be threaded out of the socket.

5 Claims, 12 Drawing Figures

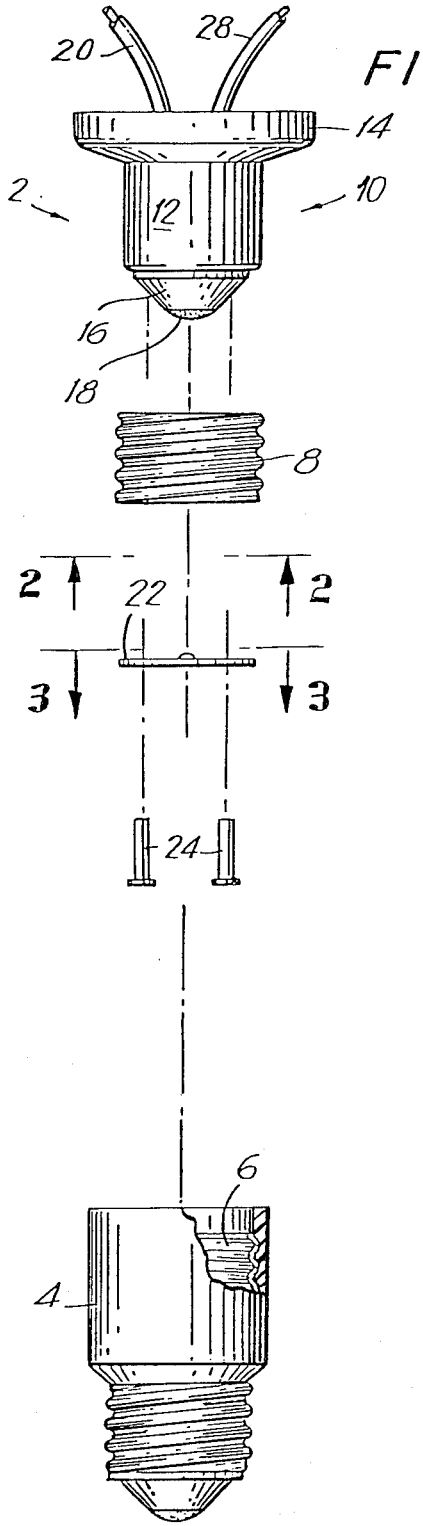
FIG. 1
FIG. 2
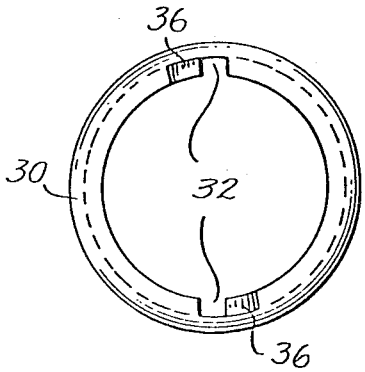
FIG. 3
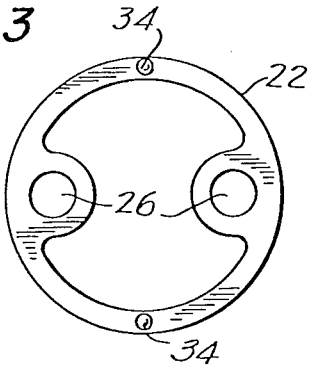
FIG. 4
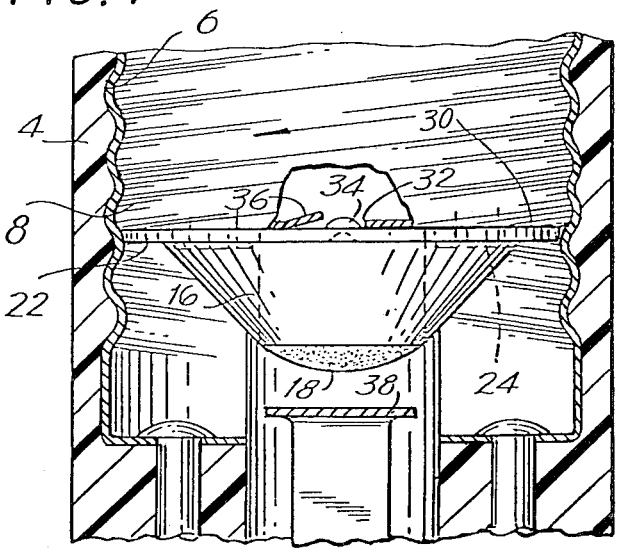

THREADED LAMP ADAPTER

This is a continuation of application Ser. No. 211,620, filed Dec. 1, 1980, now U.S. Pat. No. 4,360,243, issued Nov. 23, 1982.

BACKGROUND OF THE INVENTION

The instant invention relates to adapters for permitting electrical lamps to be threaded into light sockets. More specifically, the invention relates to an adapter for permitting an electrical lamp to be threaded into a light socket while protecting against damage to the light socket as a result of excessive torque applied to the lamp during the threading process.

It is known in the art to provide electrical adapters having threads which permit the adapter to be threaded into a correspondingly threaded socket of a light fixture and which have connection means compatible with an electrical lamp which may or may not, by itself, be provided with suitable threads for attachment to the light fixture without the use of an adapter. Some adapters have male threads suitable for engaging the female threads of a standard light socket in a light fixture and female threads suitable for receiving the male threads of a lamp such as an incandescent light bulb. Such adapters sometimes provide an AC receptacle for receiving the male plug of an electrical appliance. Other adapters have a switch means to permit the lamp to be energized and deenergized by a switch or a pull chain and are particularly useful when the light fixture is not provided with its own switch means.

Other adapters are known for use in permitting a lamp which is not, in of itself, compatible with the female threads of a standard light socket to be connected to the socket. The use of fluorescent lamps has become increasingly popular due to the high degree of light output obtainable per unit of electrical power expended and the pleasing color of the light emitted which, to the human eye, approximates daylight. Adapters are known which include a male threaded connector suitable for engaging the female threads of a standard light fixture and which are provided with a connector and supporting members suitable for engaging a fluorescent lamp and effecting electrical communication between the lamp and the power output terminals of the threaded electrical socket.

Exertion of excessive torque or rotational force on a lamp when it is being threaded into a socket often causes damage to the threads of the socket or the supporting body of the socket and sometimes results in jamming between the threaded portions of the lamp and socket which makes it difficult to remove the lamp from the socket without damaging the often fragile glass lamp. This is especially likely where the lamp is a circular fluorescent tube having a diameter much greater than that of common incandescent lamps and therefore causing substantially greater torques to be applied to the lamp socket than is the case with a smaller diameter incandescent bulb when the same rotational force is applied to both.

SUMMARY OF THE INVENTION

The instant invention overcomes the problems of the prior art discussed above in providing an inexpensive adapter which can be permanently connected to an electrical lamp and which has a threaded sleeve rotatably mounted on a body of the adapter for rotation against the force of friction relative to the body. The degree of friction between the sleeve and body is sufficient to permit the threaded portion of the adapter to be threaded into the socket of a light fixture but permits rotation of the threaded portion relative to the body when excessive torque is applied in threading the adapter into the light fixture socket thereby preventing damage to the socket. Resistance means are provided on the body and sleeve to increase the torque which must be applied to effect relative rotation between the body and sleeve for preventing relative rotation when the adapter is threaded out of the socket for removing the lamp.

It is therefore an object of the invention to provide a connector for adapting a lamp to be threaded into a lighting fixture.

Another object of te invention is to provide such a connector which permits the lamp to be rotated relative to the lighting fixture after being fully threaded therein to prevent damage to the fixture due to exertion of excessive torque on the lamp.

Still another object of the invention is to provide such a connector which can be removed from a light fixture socket by rotation of the lamp to which it is connected.

A further object of the invention is to provide such a connector wherein electrical continuity is maintained between the lamp and the threaded portion of the connector which is rotatable relative to the lamp.

Still a further object of the invention is to provide such a connector having integral cooperating means on the threaded portion thereof and the means for maintaining electrical continuity with the lamp for axially fixing the position of the threaded portion and providing increased resistance to rotation of the threaded portion relative to the body of the adapter when turned in a direction to remove the lamp from a light fixture.

Other and further objects of the invention will be apparent from the following drawings and description of a preferred embodiment of the invention in which like reference numerals are used to indicate like parts in the various views.

DESCRIPTION OF THE DRAWINGS

FIG. 1 is an exploded elevation view of a first preferred embodiment of a connector in accordance with the invention in relation to its intended environment;

FIG. 2 is an axial view of the first embodiment of the invention taken along line 2-2 of FIG. 1;

FIG. 3 is an axial view of the first embodiment of the invention taken along line 3-3 of FIG. 1;

FIG. 4 is a sectional elevation of the first embodiment of the invention as it is being installed in its intended environment;

DESCRIPTION OF THE PREFERRED EMBODIMENTS

Figure 5:
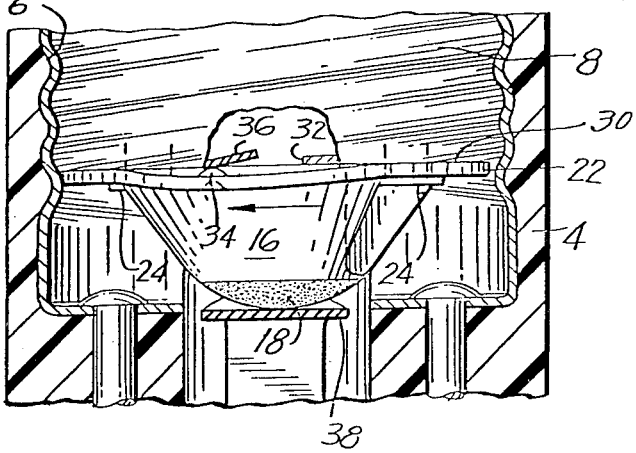
FIG. 5 is a sectional elevation of the first embodiment of the invention after it is installed in its intended environment.
Figure 7:
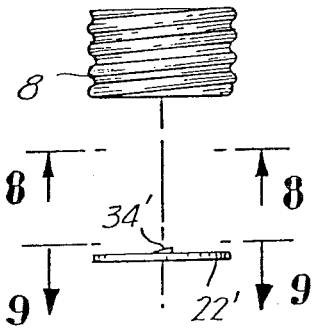
FIG. 7 is an exploded elevational view showing components of a second preferred embodiment of the invention.

Referring now to FIGS. 1, 2 and 3 of the drawings, there is shown in FIG. 1 a connector 2 in accordance with the first preferred embodiment of the invention and an electrical socket 4 which can be a socket of a light fixture which is adapted to receive a standard threaded incandescent light bulb. The socket 4 includes threads 6 within its cylindrical bore which can receive the threads of a standard incandescent light bulb or the threads of a hollow cylindrical sleeve 8 on the adapter 2.

The adapter 2 has a body 10 with a smooth cylindrical surface 12 which terminates at one end in an outward tapering circular flange 14 and at the other end in an inward tapering nose portion 16. The cylindrical portion 12, flange 14 and nose portion 16 of the body 10 are made of an insulating material which is, in the preferred embodiments of the invention, a hard plastic.

At the tip of the nose portion 16 there is an electrical terminal 18 which can be held in place by a rivet. An electrical conductor such as an insulated wire 20 can be connected to the terminal 18 at one of its ends and at the other of its ends to one of the energizing terminals of an electrically actuated lamp (not shown).

The threaded cylindrical ring 8 has an inner diameter just slightly greater than the outer diameter of the cylindrical surface 12 of the body 10 and an axial length just slightly shorter than the axial length of the cylindrical portion 12. In the assembled adapter 2 the sleeve 8 is mounted on the body 10 in circumscribing relationship with the cylindrical surface 12, the sleeve 8 being rotatable relative to the surface 12 about a common axis.

A securing or retaining ring 22 having a diameter substantially equal to the diameter of the sleeve 8 is mounted about the end of the cylindrical portion 12 of the connector body 10 adjacent the nose portion 16 by means of two mounting studs or rivets 24 which are passed through respective apertures 26 formed in the retaining ring 22 and then through respective diametrically opposite cylindrical bores in the body 10 having axes displaced from and parallel to the common axis of the cylindrical surface 12 and sleeve 8.

The securing ring 22 and the studs 24 are, in the preferred embodiments of the invention, made of a conducting material, such as a metal. The ring 22 is urged against the sleeve 8 in the axial direction by the rivets 24 thereby maintaining the ring 22 in electrical contact with the sleeve 8. The sleeve 8 is rotatable relative to the ring 22 about the cylindrical body portion 12. There is a degree of friction between the sleeve 8 and body 10, including the ring 22, which requires application of a minimum torque to the sleeve 8 relative to the body 10 for rotation between the sleeve and body to occur. A second electrical conductor 28 can be connected to the ring 22 by means of one or both of the rivets 24 as for example by crimping or soldering. This places the conductor 28 in electrical contact with the sleeve 8 irrespective of the rotational disposition of the sleeve 8 with respect to the body 10.

The end of the sleeve 8 adjacent the nose portion 16 of the body 10 extends radially inwardly to form a rim portion or lip 30 which abuts against the surface of the ring 22. On the rim portion 30 are formed two diametrically opposite openings in the form of rectangular notches 32 which are adapted to receive diametrically opposite projections 34 on the surface of the ring 22. In the first embodiment of the invention, the projections 34 have cam surfaces which are substantially hemispherical.

As the sleeve 8 is rotated about the cylindrical surface 12 of the body 10 with the projection 34 out of registration with the notches 32, the rim portion 30 of the sleeve 8 rides over the cam projections 34. As the notches 32 come into registration with the projections 34 the projections 34 are received in the notches 32 thereby necessitating the application of increased torque to rotate the sleeve 8 relative to the ring 22 and, hence, the body 10. Upon application of such increased torque the spherical surfaces of the projections 34 cause the projections 34 to be urged axially away from the rim portion 30 as the sleeve 8 is rotated relative to the body 10. Once out of the notches 32 the projections 34 again ride on the rim portion 30 of the sleeve 8 thereby lessening the degree of torque required for relative rotation of the sleeve 8 with respect to the body 10.

The portions of the rim 30 immediately adjacent the notches 32 in the counterclockwise direction in the view of FIG. 2 can be axially recessed thereby forming ramp portions 36. The projections 34 can ride over the ramp portions 36 to lessen the degree of torque necessary for rotating the sleeve 8 relative to the body 10 and ring 22 in the clockwise direction as compared with the degree of torque necessary for rotation of the sleeve 8 in the counter-clockwise direction with respect to the body 10 as viewed in the direction of the arrows of section line 2-2 in FIG. 1. This construction results in the slippage of the sleeve 8 over the cylindrical portion 12 of the body 10 after the sleeve portion 8 is fully threaded into the threads 6 of the socket 4 to prevent damage to the socket 4 and permits the sleeve 8 to be threaded out of the socket 4 when the body 10 is rotated counter-clockwise relative to the socket 4 as seen from a view following the direction of the arrows on section line 3-3 in FIG. 1.

The operation of the first preferred embodiment of the invention will now be explained with reference to FIGS. 4, 5 and 6. In FIG. 4, the adapter 2 is being threaded into the socket 4 and the terminal 18 is moving downwardly toward engagement with the corresponding socket terminal 38. Although FIG. 4 shows the cam projection 34 captured in the notch 32, this relative disposition of the projection 34 and notch 32 is not necessary during threading of the adapter into the socket as there will normally be sufficient friction between the sleeve 8 and ring 22 to permit the adapter to be threaded into the socket 4 without relative rotation between sleeve 8 and body 10.

Figure 6:
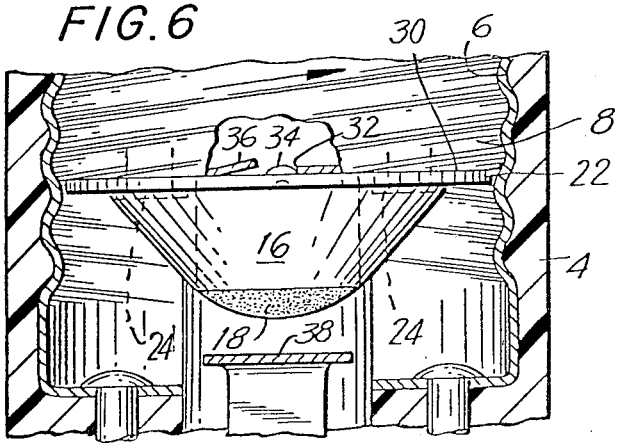
FIG. 6 is a sectional elevation of the first embodiment of the invention as it is being removed from installation in its intended environment.
Figure 8:
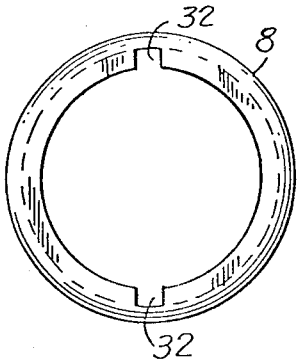
FIG. 8 is an axial view taken through line 8-8 of FIG. 7.

When the connector 2 is fully threaded into the socket 4 with the terminals 18 and 38 in mutual engagement, as shown in FIG. 5, continuous application of rotational force or torque causes the body 10 with ring 22 to rotate relative to the sleeve 8 with the cam projection 34 passing beneath the rim portion 30 adjacent the corresponding notch 32. As rotation of the connector is continued, the sleeve 8 remains stationary so that no damaging force is applied to the socket 4.

When it is desired to remove the connector 2 from the socket 4, it is rotated counter-clockwise. As shown in FIG. 6, when the cam projection 34 comes into registration with a corresponding notch 32, it is captured in the notch 32 so that increased resistance to relative rotation between the sleeve 8 and ring 22 which is affixed to the body 10 is presented. Since the force necessary to turn the body 10 relative to the sleeve 8 is now greater than the force necessary to turn the sleeve 8 relative to the threads 6 of the socket 4, upon continued counterclockwise rotation of the connector body 10 the sleeve 8 rotates with it and is threaded out of the socket 4 as shown in FIG. 6.

A second preferred embodiment of the invention will now be described with reference to FIGS. 7–12. The second preferred embodiment of the invention is similar to the first embodiment with the exception that a ring 22' is substituted for the ring 22 of the first preferred embodiment. The ring 22' has on its surface projections 34' comprising cam surfaces in the form of substantially flat sloping truncated ramps. This configuration of the projection 34' facilitates relative rotation between the sleeve 8 and ring 22' when the connector 2 is rotated clockwise after being fully threaded into the socket 4 and offers increased resistance to relative rotation between the sleeve 8 and ring 22' when the connector 2 is rotated counter-clockwise for threading out of the socket 4. Since the cam surface of the projection 34' is biased to facilitate relative rotation in the tightening (clockwise) direction and to present resistance to relative rotation in the removal (counter-clockwise) direction the ring 22' need not be provided with ramp portions adjacent the notches 32 although such ramp portions can be included to further facilitate rotation in the tightening direction.

The cam projection 34' can be formed on the ring 22' by a punching operation whereby a punch is applied to the side of the ring 22' opposite the side from which the projection 34' protrudes from it.

Figure 10:
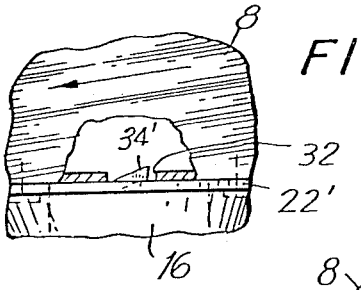
FIG. 10 is a fragmented sectional elevation of the second embodiment of the invention in one disposition after being installed in its intended environment.
Figure 9:
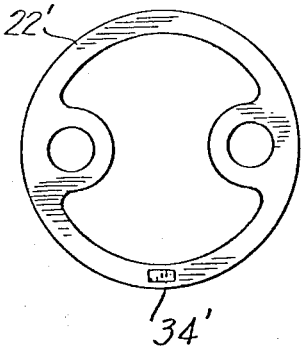
FIG. 9 is an axial view taken through line 9-9 of FIG. 7.
Figure 11:
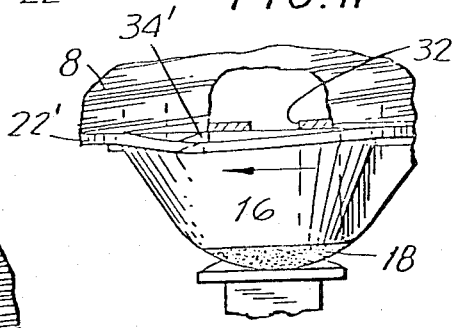
FIG. 11 is a sectional elevation of parts of the second embodiment of the invention in another disposition after installation in its intended environment.
Figure 12:
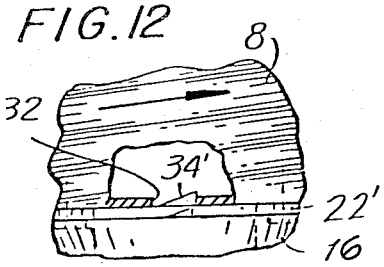
FIG. 12 is a sectional elevation showing parts of the second embodiment of the invention as it is being removed from installation in its intended environment.

As can be seen from FIGS. 10, 11 and 12 the operation of the second preferred embodiment of the invention is similar to that described with respect to the first preferred embodiment. In FIG. 10 the cam projection 34' is captured in the notch 32 of the ring 22' as the connector is threaded into a light fixture socket 4. Once the connector is fully threaded into the socket 4 the cam projection 34' slips beneath the ring 22' and the sleeve 8 remains stationary as the body 10 with ring 22' affixed to it continues to rotate in response to the applied torque used to thread the connector into the socket 4. The torque applied to the connector 2 will, often, be applied through the turning of the lamp (not shown) which is fixed to the connector 2.

When the connector 2 is to be threaded out of the socket 4, it is rotated in the counter-clockwise direction, as shown in FIG. 12, at which time the cam projection 34' is captured in the notch 32 and a perpendicular surface of the cam projection 34' engages the edge of the notch 32 thereby presenting resistance to relative rotation between the sleeve 8 and ring 22' so that the sleeve 8 is rotated with the body 10 causing it to be threaded out of the socket 4.

It is to be appreciated that the invention has been described with reference to preferred embodiments to which variations can be made without departing from the spirit and scope of the invention which is to be limited only by the following claims.

What is claimed is:

1. A connector for adapting a lamp to be threaded into a lighting fixture comprising:

a body adapted to receive first electrical conductor means connectable to an energizing terminal of said lamp, a sleeve having threads at least on its exterior surface for connection to a threaded light socket and rotatably mounted on said body, said body including retaining means for limiting axial movement between said body and said sleeve, first resistance means on said body member, and second resistance means on said sleeve member, said first and second resistance means operating to increase the torque necessary to rotate said sleeve relative to said body when said sleeve is in a predetermined disposition relative to said body, said first and second resistance means comprising a projection and the other of said first and second resistance means has an opening adapted to receive said projection, and, said first resistance means being formed on said retaining means.

2. Apparatus according to claim 1 wherein said projection has a cam surface permitting it to be disengaged from said opening upon application of a predetermined torque between said sleeve and said body.

3. Apparatus according to claim 2 wherein said cam surface is rounded.

4. Apparatus according to claim 2 wherein said cam surface includes a truncated ramp to permit disengagement only upon relative rotation in one direction.

5. Apparatus according to claim 2 wherein said sleeve portion slopes on one side of said opening to facilitate disengagement in only one direction of relative rotation.

* * * * *